US008714089B2

(12) United States Patent
Prelic et al.

(10) Patent No.: US 8,714,089 B2
(45) Date of Patent: May 6, 2014

(54) ACTIVATION UNIT FOR EXPLOSIVE MASSES OR EXPLOSIVE BODIES

(75) Inventors: Nenand Prelic, Anger (DE); Oliver Frank, Siegsdorf (DE); Heribert Eglauer, Berchtesgaden (DE); Florian Huber, Anger (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 48 days.

(21) Appl. No.: 13/291,281

(22) Filed: Nov. 8, 2011

(65) Prior Publication Data

US 2012/0137913 A1 Jun. 7, 2012

Related U.S. Application Data

(63) Continuation-in-part of application No. PCT/EP2010/002332, filed on Apr. 16, 2010.

(30) Foreign Application Priority Data

May 8, 2009 (DE) ..... 10 2009 020 557
May 8, 2009 (DE) ..... 10 2009 020 558

(51) Int. Cl.
*F42B 3/10* (2006.01)
*F42B 3/12* (2006.01)

(52) U.S. Cl.
CPC .... *F42B 3/10* (2013.01); *F42B 3/12* (2013.01)
USPC ..... 102/202.5; 102/202.14; 102/334; 102/336; 102/342

(58) Field of Classification Search
CPC ..... F42B 3/13; F42B 3/11; F42B 3/04; F42B 3/124; F42B 3/195; F42B 3/155; F42B 3/006; F42B 3/103; F42B 3/12; F42B 3/16; F42B 3/198; F42B 3/128; F42B 3/185; F42B 3/188; F42B 4/26; F42B 4/00; F42B 5/15; F42B 10/661; F42B 33/0207; F42D 1/055; F41B 11/51; F41B 11/57; F41H 11/02; F41H 9/06; F41J 2/02
USPC ..... 102/202.5, 202.14, 334, 336, 342
See application file for complete search history.

(56) References Cited

U.S. PATENT DOCUMENTS 2,787,217 A 3/1953 Mahaffie
2,678,603 A 5/1954 Prince, Jr. et al.

(Continued)

FOREIGN PATENT DOCUMENTS

CA 2146015 A1 2/1995
DE 649 530 C 8/1937

(Continued)

OTHER PUBLICATIONS

McGraw-Hill Dictionary of Scientific and Technical Terms (Sixth Ed.) 814 (2003).

(Continued)

*Primary Examiner* — Samir Abdosh
(74) *Attorney, Agent, or Firm* — Griffin & Szipl, P.C.

(57) ABSTRACT

An activation unit for explosive masses or explosive bodies includes an ejector tube and high-performance heating elements mounted around the ejector tube, each made of at least one heating wire supplied with electrical power by a control unit. Each heating wire is enclosed in a casing and embedded in a material minimizing heat loss. When the explosive body is passed through the activation unit, the jacket surface of the explosive body contacts the individual elements of the activation unit in a direct or non-contact manner. Thermal energy is transferred to the explosive body by means of the heating wires, and the body ignites at the contact points. A further activation unit includes heating elements in the ejector tube, at least partially fed longitudinally through the ejector tube, made of heating wire clad with CrNi steel and contact plates soldered thereto.

11 Claims, 6 Drawing Sheets

(56) References Cited

U.S. PATENT DOCUMENTS

| | | | | |
|---|---|---|---|---|
| 3,216,410 | A | 11/1965 | Trombatore et al. | |
| 3,628,416 | A | 12/1971 | Kernan | |
| 3,760,729 | A | 9/1973 | Freeman | |
| 4,002,122 | A * | 1/1977 | Gould | 102/202 |
| 4,060,435 | A | 11/1977 | Schroeder | |
| 4,068,591 | A | 1/1978 | Betts | |
| 4,096,804 | A | 6/1978 | Bilsbury | |
| 4,374,494 | A | 2/1983 | Maury | |
| 4,409,898 | A * | 10/1983 | Blix et al. | 102/202.5 |
| 4,624,186 | A | 11/1986 | Widera et al. | |
| 4,838,167 | A | 6/1989 | Prahauser et al. | |
| H0778 | H | 5/1990 | Carlton et al. | |
| 5,074,216 | A | 12/1991 | Dunne et al. | |
| 5,635,666 | A | 6/1997 | Bannasch et al. | |
| 5,929,369 | A | 7/1999 | Bissig et al. | |
| 5,992,327 | A | 11/1999 | Wardecki et al. | |
| 6,055,909 | A | 5/2000 | Sweeny | |
| 6,427,599 | B1 | 8/2002 | Posson et al. | |
| 6,513,438 | B1 | 2/2003 | Fegg et al. | |
| 6,659,012 | B1 | 12/2003 | Grassi et al. | |
| 6,666,351 | B1 | 12/2003 | Hartz et al. | |
| 7,343,861 | B1 | 3/2008 | Baker | |
| 7,363,861 | B2 | 4/2008 | Brune et al. | |
| 7,421,950 | B2 | 9/2008 | Dillard et al. | |
| 7,516,700 | B1 | 4/2009 | Callaway | |
| 7,584,702 | B1 | 9/2009 | Sutherland et al. | |
| 7,866,265 | B1 | 1/2011 | Kravel et al. | |
| 7,992,496 | B2 | 8/2011 | Dillard et al. | |
| 8,146,504 | B2 | 4/2012 | Wallner et al. | |
| 8,276,518 | B2 | 10/2012 | Dillard et al. | |
| 2002/0011173 | A1 | 1/2002 | Schildknecht et al. | |
| 2003/0116050 | A1 * | 6/2003 | Brum et al. | 102/336 |
| 2004/0139876 | A1 * | 7/2004 | Wilson et al. | 102/202.11 |
| 2004/0244626 | A1 | 12/2004 | Ehmig | |
| 2006/0032391 | A1 | 2/2006 | Brune et al. | |
| 2006/0201372 | A1 * | 9/2006 | Nicolae | 102/342 |
| 2007/0039505 | A1 | 2/2007 | Dillard et al. | |
| 2009/0007768 | A1 | 1/2009 | Wallner et al. | |
| 2009/0095186 | A1 | 4/2009 | Dillard et al. | |
| 2009/0301336 | A1 | 12/2009 | Wardecki et al. | |
| 2010/0288111 | A1 | 11/2010 | Kunz | |
| 2011/0146520 | A1 | 6/2011 | Guth | |
| 2011/0174182 | A1 | 7/2011 | Guth et al. | |
| 2012/0160121 | A1 | 6/2012 | Prelic et al. | |

FOREIGN PATENT DOCUMENTS

| | | | |
|---|---|---|---|
| DE | 23 59 758 | C1 | 7/1988 |
| DE | 94 14 263 | U1 | 10/1994 |
| DE | 197 56 204 | C1 | 3/1999 |
| DE | 199 10 074 | A1 | 9/2000 |
| DE | 199 51 767 | A1 | 5/2001 |
| DE | 103 23 531 | B3 | 2/2005 |
| DE | 10 2005 020 159 | A1 | 7/2007 |
| DE | 10 2006 004 912 | A1 | 7/2007 |
| DE | 196 49 892 | A1 | 7/2008 |
| DE | 10 2007 032 112 | A1 | 1/2009 |
| DE | 10 2009 020 558 | A1 | 11/2010 |
| DE | 10 2009 030 868 | A1 | 1/2011 |
| EP | 0 204 115 | A2 | 12/1986 |
| FR | 715 614 | A | 12/1931 |
| GB | 250 271 | A1 | 10/1926 |
| JP | 11-173796 | | 7/1999 |
| WO | 00/19164 | A1 | 4/2000 |
| WO | 2007/087948 | A1 | 8/2007 |
| WO | 2010/003496 | A1 | 1/2010 |
| WO | 2010/149291 | A1 | 12/2010 |

OTHER PUBLICATIONS

"United States Naval Pyrotechnical Compositions," at http://www.google.com/urlsa=t&rct=j&q=&esrc=s&source=web&cd=9&ved=0CGYQFjAl&url=http%3A%2F%2Fwww.ammunitionpages.com%2Fdownload%2F237%2FUS%2520navy%2520pyrotechnicspdf&ei=zjl6UsagMLXi4AOnw4Fw&usg=AFQjCNGhmQURaXkLjZAol124l0jajOymlg&sig2=vw04ff4-VMe_PYiiD8aZzw&bvm=bv.52434380,d.dmg (downloaded Sep. 18, 2013, five pages).

S.M. Danali et al., Developments in Pyrotechnics, 60 Defense Science Journal 152-158 (2010).

Clarence W. Gilliam et al., Flare, Igniter and Pyrotechnic Disposal: Red Phosphorous Smokes, Naval Ammunition Depot, AD-A013 182 (1975).

"Pyrotechnic Chemistry," at http://www.islandgroup.com/military/pyrotechnic_chemistry.php (2013)(downloaded Sep. 18, 2013, two pages).

Charles A. Knapp, New Infrared Flare and High-altitude Igniter Compositions, Feltman Research and Engineering Laboratories, Picatany Arsenal (1959).

Rui Shu, Explosive Chemistry: The History and Chemistry of Explosives, Dartmouth Undergraduate Journal of Science 21-23 (2012).

Gao Guangyan, Nitrocellulose Synthesis Outline, at http://www.loneoceans.com/labs/nitrocellulose/ (2012).

Random House Webster's College Dictionary 506 (1991).

Notice of Allowance issued in co-pending U.S. Appl. No. 13/380,959 on Nov. 26, 2013.

International Search Report issued in co-pending related application PCT/EP2009/004113, completed Sep. 29, 2009 and mailed Oct. 6, 2009.

International Search Report issued in co-pending related application PCT/EP2009/004114, completed Oct. 1, 2009 and mailed Oct. 13, 2009.

International Search Report and IPRP issued in PCT/EP2010/003567, completed Sep. 16, 2010 and mailed Sep. 22, 2010.

International Search Report and IPRP issued in PCT/EP2010/003565, completed Aug. 31, 2010 and mailed Sep. 7, 2010.

International Search Report and IPEP issued in PCT/EP2010/003566, completed Aug. 27, 2010 and mailed Sep. 7, 2010.

"Stainless Steels," at http://www.dew-stahl.com/fileadmin/files/dew-stahl.com/documents/Publikationen/Broschueren/015_DEW_RSH_GB.pdf (downloaded Dec. 2, 2013).

English translation (Jan. 2012) of the Written Opinion of the International Searching Authority in PCT/EP2010/003565.

Notice of Allowance issued in co-pending U.S. Appl. No. 13/380,959 on Aug. 22, 2013.

International Search Report issued in corresponding application PCT/EP2010/002332, completed Jun. 29, 2010 and mailed Jul. 6, 2010.

* cited by examiner

ACTIVATION UNIT FOR EXPLOSIVE MASSES OR EXPLOSIVE BODIES

This is a Continuation-in-Part Application in the United States of International Patent Application No. PCT/EP2010/002332 filed Apr. 16, 2010, which claims priority on German Patent Application No. 10 2009 020 558.6, filed May 8, 2009, and on German Patent Application No. 10 2009 020 557.8, filed on May 8, 2009. The entire disclosures of the above patent applications are hereby incorporated by reference.

FIELD OF THE INVENTION

The invention relates to an activation unit for, in particular, munition-free explosive masses or explosive bodies, for example, for forming decoys.

BACKGROUND OF THE INVENTION

Decoys and/or smoke shells based, for example, on red phosphorus (RP) or nitrocellulose (NC), are used in military applications, for example, smoke shells, infrared (IR)-acting aircraft decoys, etc. The smoke or IR effect is deployed by the RP/NC after appropriate ignition by burning. RP units (i.e., explosive bodies) are ignited via an ignition or break-up charge, which ensures that the bodies can be optimally ignited, and can then burn, for the respective purpose.

DE 10 2007 032 112 A1 describes so-called "jammers," which are fired from a launching apparatus having a plurality of launching tubes. Launching is performed in a manner initiated electrically or mechanically. The sub-clocking for initiating the individual light flashes is controlled by an electronics system that is incorporated in the apparatus. A plurality of sub-bodies are ignited in a manner clocked in time in order to initiate the light flashes or break-up flashes. To this end, the sub-bodies have pyrotechnic ignition or break-up charges.

DE 199 10 074 B4 describes a launching apparatus for firing a plurality of explosive bodies. The explosive bodies, which can be fired in this case, each have a drive charge with an ignition means, for example, a firing cap, which is connected to a control unit of the adapter when the explosive-body pack and adapter are in the assembled state.

Decoys of this kind cannot be used in civil aviation because of the munition component since explosives are not acceptable in this context and international safety agreements, etc., have to be complied with.

Proceeding from the above background, a novel ignition concept has been developed, wherein this ignition concept does not require explosive and/or pyrophoric substances to ignite RP/NC flares.

This novel ignition concept is described in more detail in DE 10 2006 004 912 A1. This document discloses a system for protection, in particular, of large flying platforms, such as aircraft, against a threat guided by IR or radar. In this case, the explosive bodies are preferably activated or ignited contactlessly. The explosive bodies are then ejected pneumatically or mechanically. The explosive bodies themselves are munition-free packs that are ignited by means of hot air or a laser.

Building on this activation concept, the present invention is based on the object of specifying an activation unit that activates such explosive bodies in order to produce decoys.

SUMMARY OF THE INVENTION

The object of the invention is achieved by the features of first and seventh illustrative embodiments of the present invention. Advantageous embodiments can be found in the second to sixth and eighth to tenth illustrative embodiments.

In particular, in accordance with the first illustrative embodiment of the present invention, an activation unit (1) for munition-free explosive masses or explosive bodies (3) is provided, and characterized by an ejection tube (2) and high-power heating elements (4) that are fitted in the ejection tube (2) and, in each case, consist of at least one heating wire (6) which, for its part, is supplied with electric current by a regulation unit (30). In accordance with a second illustrative embodiment of the present invention, the first embodiment is modified so that each heating wire (6) is held in a casing (7). In accordance with a third illustrative embodiment of the present invention, the second embodiment is further modified so that the casing (7) is a highly temperature-resistant steel with a high CrNi content. In accordance with a fourth illustrative embodiment of the present invention, the first embodiment, the second embodiment, and the third embodiment, are further modified so that the respective heating wire (6) is embedded at least in a material which minimizes heat loss. In accordance with a fifth illustrative embodiment of the present invention, the fourth embodiment is further modified so that the material is a ceramic inlay (8). In accordance with a sixth illustrative embodiment of the present invention, the first embodiment, the second embodiment, the third embodiment, the fourth embodiment, and the fifth embodiment, are further modified so that the heating elements (4) are held in the ceramics (8) for mechanical strain relief in a metal structure of the ejection tube (2), wherein the metal structure corresponds to the respective external shape of the explosive body (3).

In accordance with a seventh illustrative embodiment of the present invention, an activation unit (1', 1") for munition-free explosive masses or explosive bodies (3) is provided, and characterized by an ejection tube (2',2") and heating elements (10, 10') that are longitudinally routed at least partially through the ejection tube (2', 2") in the ejection tube (2', 2") and comprise heating wire (14), which is sheathed (11) with CrNi steel, and contact plates (13) that are soldered onto the heating wire. In accordance with an eighth illustrative embodiment of the present invention, the seventh embodiment is modified so that the heating elements (10) are routed along through the entire length of the ejection tube (2'). In accordance with a ninth illustrative embodiment of the present invention, the seventh embodiment or the eighth embodiment is further modified so that the ejection tube (2', 2") has a thermal insulation means (15), for example, formed by one/several ceramic inlay(s). In accordance with a tenth illustrative embodiment of the present invention, the ninth embodiment is further modified so that the thermal insulation means (15) is incorporated on the inner surface of the ejection tube (2', 2") between the sheathed heating wires (14) and the ejection tube (2', 2").

Fundamentally, the invention is based on the above-mentioned idea of activating (of igniting) the explosive masses/flare material by supplying thermal energy. This avoids the use of explosives.

In order to activate the explosive body, the explosive body is thus subjected to the action of thermal energy in a suitable form. This can be achieved by the explosive body, which generally comprises individual flares, that are forced through an ignition tube for activation purposes. The "ejection" can be performed pneumatically or mechanically.

To this end, an ignition tube 12, from which the explosive masses are ejected, has a high-temperature activation element that consists essentially of "n" heating elements, which are arranged geometrically separately from one another, radially around the circumference of an ignition tube. The geometry of the activation unit is not necessarily a circular cylinder. The heating elements can also be matched to other geometries, for example, to a rectangular cylinder.

The material chosen for the individual heating elements allows temperatures of >600° C., with the heating elements being designed such that they allow extremely dynamic heating on account of small masses. The outer casing of the heating wire of the heating elements is preferably composed of a highly temperature-resistant steel with a high CrNi content. Furthermore, ceramic inlays, for example, ensure further thermal optimization by minimizing heat losses. The heating elements are designed such that they ensure ideal energy input into the explosive body for the application. The heating element can additionally be provided, for example, with contact plates, or the like, for improved energy transfer. This thermal optimization and appropriate control engineering result in an extremely short reaction time of the heating elements, which is to say that the heating time from the switch-on point to reaching the nominal temperature is extremely short (i.e., low or small).

Any desired number of heating elements may be used and may be selected, and the heating elements may, in principle, be prefabricated in any shape. It is therefore possible to ideally set the energy input for each application, on the one hand, by the choice of the number "n" of heating elements and/or, on the other hand, by adapted control engineering.

Depending on the application, the explosive body can be ignited by contact with the heating elements or else contactlessly. To this end, it is possible to activate the explosive body as it "flies past" the heating elements without contacting the heating elements directly.

This form of activation allows the use of decoys without explosives in the civil environment, not only in civil aviation, but also for civil seaborne targets and land vehicles. The design and safety requirements for decoys and dispensers without explosives are simpler, which is to say considerably less stringent. The ignition unit or apparatus allows a multiplicity of ignition operations, while that operation for traditional flares is intended to be used only once.

The extremely high CrNi content results in a high susceptibility to corrosion, a high temperature resistance and a relatively high wear resistance. The separate casing and routing of the elements ensures the leaktightness of the heating elements. The casing is free of potential, and traditional short-circuit links are, therefore, excluded. It is likewise possible to adapt the power to a slight extent by changing the length or simply changing the circuitry of the heating elements. The functional reliability can be increased by current, which is preferably carried in multiple circuits through the "n" heating elements. The contactless and flexible suspension/incorporation of the heating elements permits only low levels of loss and improved contact-making. The explosive-body tolerances could be better compensated for by clean routing of the explosive-body pack.

Practice of the invention has shown that ignition over a large surface area (surface area of approximately 80%) is achieved with a low mass (and therefore with a minimal thermal inertia for ensuring dynamic heating regulation).

BRIEF SUMMARY OF THE DRAWINGS

The invention will be explained in more detail with reference to an exemplary embodiment and drawings, in which.

DETAILED DESCRIPTION OF THE INVENTION

Figure 1:
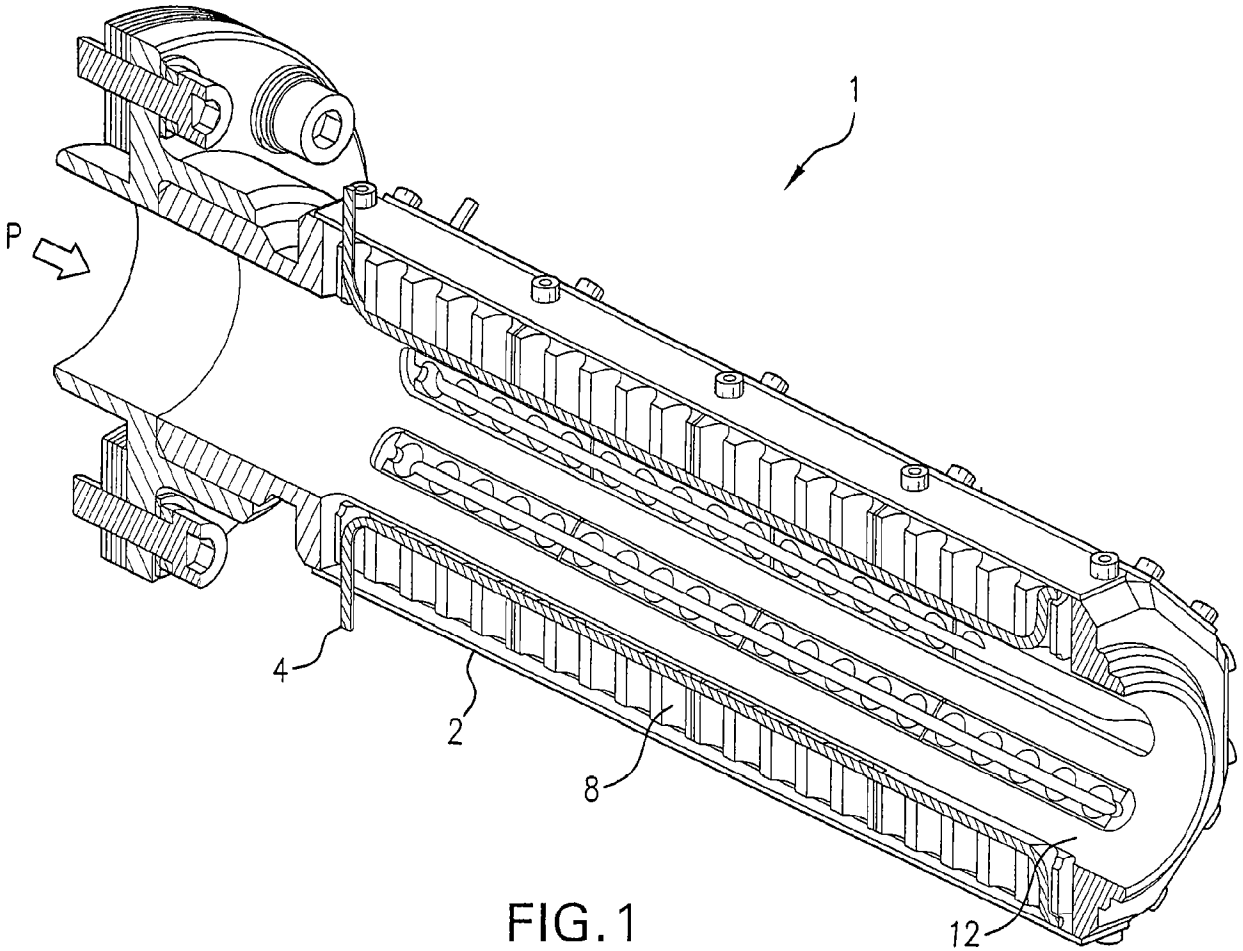
FIG. 1 shows an activation unit with an ejection tube for an explosive body, in accordance with the present invention.

In the sectional view illustrated in FIG. 1, 1 denotes an activation unit. The high-temperature activation unit 1 substantially comprises an ejection tube 2 from which an explosive body 3 (FIG. 5), which is not illustrated in any more detail here, is ejected in the direction of the arrow P. The ejection tube 2 is surrounded by high-temperature heating elements 4 on its inner face/surface, with each individual element 4 being formed from a heating wire 6 that is held in a casing 7, protected against external influences, and is preferably embedded in a material that minimizes heat loss, preferably in a ceramic inlay 8. In the preferred embodiment, the outer casing 7 of the heating element 4 is composed of a highly temperature-resistant steel provided with a high CrNi content. For mechanical strain relief, the ceramics 8 are held in the metal structure of the ejection tube 2, with the metal structure corresponding to the external shape of the explosive body 3, in this case a cylindrical shape. Alternative forms are likewise possible.

Figure 6:
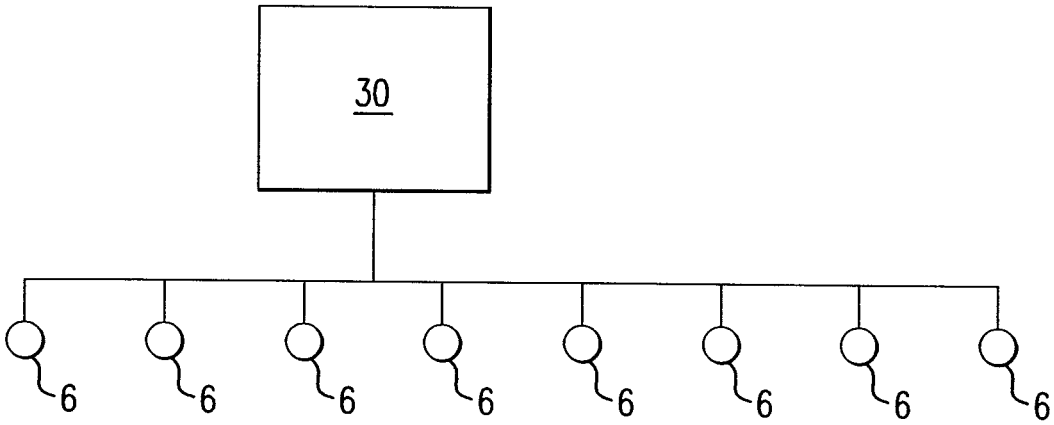
FIG. 6 schematically shows the regulation unit that supplies electric current to the eight heating wires of the heating element configuration shown in FIG. 2.

The heating wires 6 are supplied by appropriate control engineering (not illustrated in any more detail than by the regulation unit 30 shown in FIG. 6) with the appropriate electrical energy, and are thus heated to >600° C. The ceramic inlays 8 themselves improve the energy balance of the respective heating element 4, and in the process ensure more efficient introduction of energy from the explosive body 3.

Figure 2:
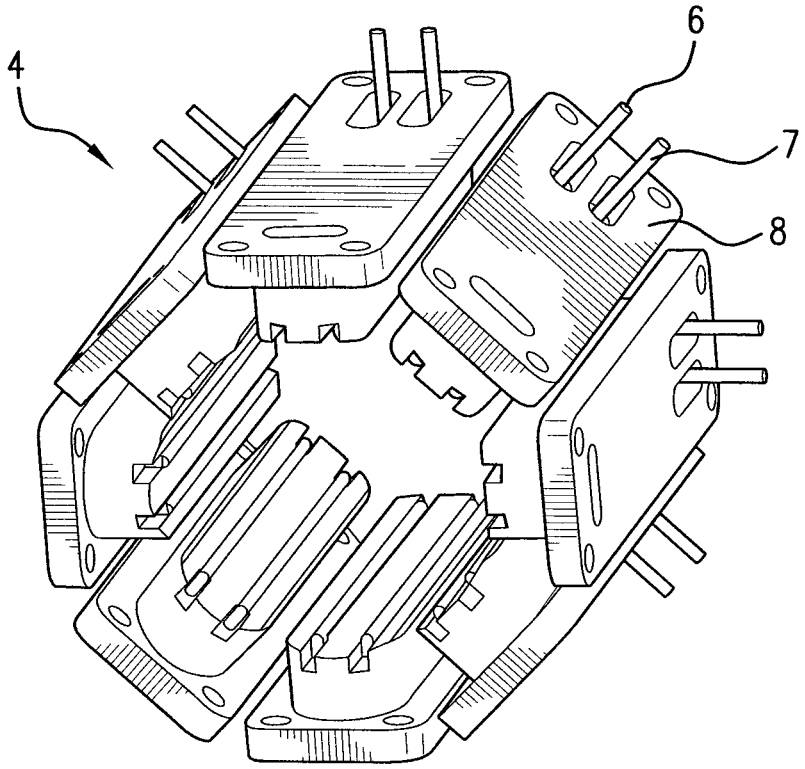
FIG. 2 shows heating elements of the activation unit from FIG. 1 arranged to form an ignition tube 12, such as is disposed in the ejection tube 2 of FIG. 1.

FIG. 2 shows a variant of the arrangement and of the design of heating element 4, which is embedded in the ceramic inlay 8.

Figure 3:
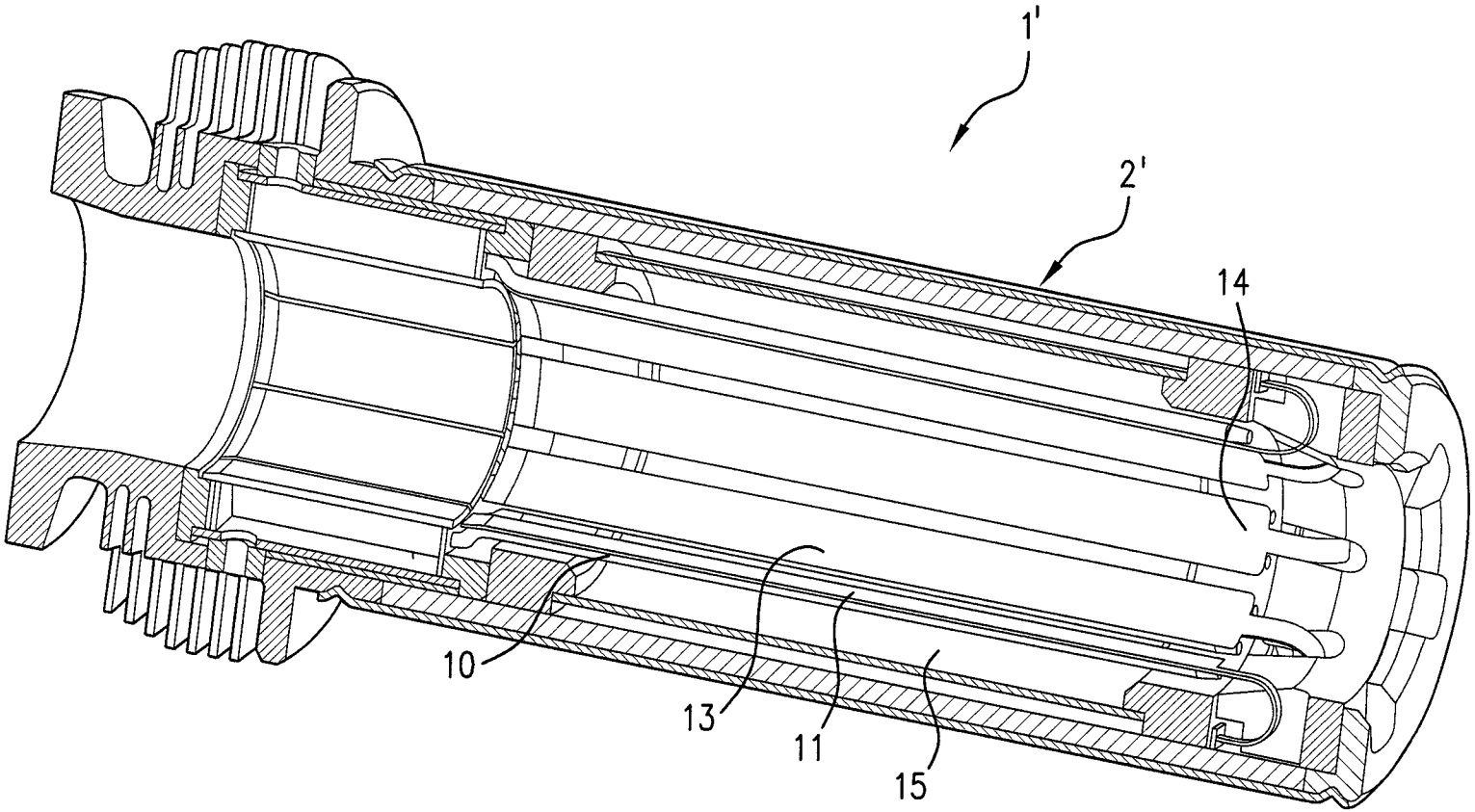
FIG. 3 shows a variant of the design of the ejection tube, in accordance with the present invention.

FIG. 3 shows a further variant of the activation unit 1' with an ejection tube 2'. In this FIG. 2, 10 denotes heating elements that are routed along through the tube 2' and have a CrNi steel casing 11, wherein the heating wire surface of the tube 2' is increased in size by at least one, for example soldered-on, contact plate 13, as a result of which the contact area of the heating wire 14 relative to the explosive body 3 is also increased in size. The ejection tube 2' has a thermal insulation means 15, for example, formed by one/several ceramic inlay(s).

Figure 4:
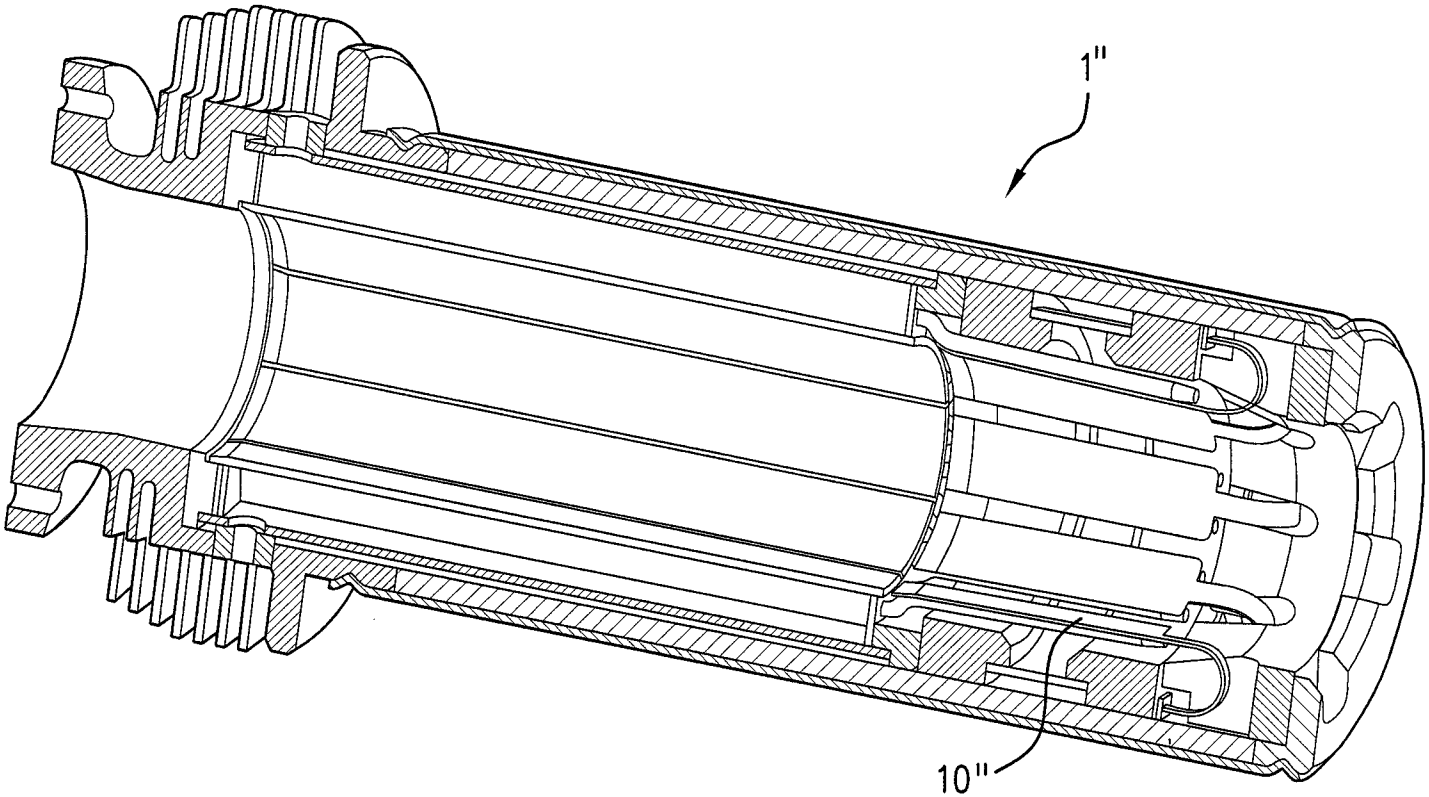
FIG. 4 shows a further embodiment of the ejection tube, in accordance with the present invention.

FIG. 4 shows another embodiment of the activation unit 1" having an ejection tube 2". In this embodiment, short heating elements 10" are used similarly to those above. In FIG. 4, the short heating elements 10" are shown at a distal portion of the ejection tube 2".

Figure 5:
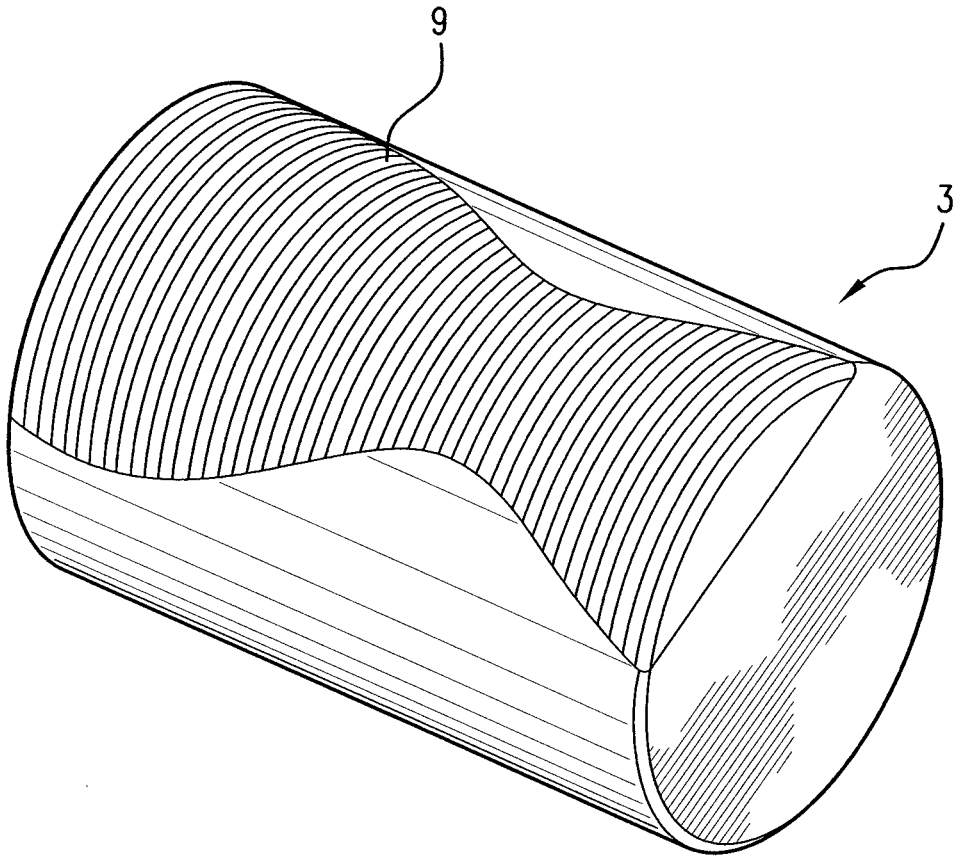
FIG. 5 shows an explosive body, which is to be dispatched from the ejection tube.

FIG. 5 shows the design of the explosive body 3, such as is ejected from the ejection tube of the activation unit of the present invention. The explosive body is distinguished by a plurality of individual flares 9, and may have a cylindrical configuration.

The functioning to the activation unit with an explosive body is described as follows:

The explosive body 3 is forced through the activation unit 1 (1', 1"), by way of example, by a plunger (i.e., an eject unit—not illustrated in any more detail). When the explosive body 3 passes through the activation unit 1, the casing surface of the explosive body 3 makes contact with the individual elements 4 of the activation unit 1. Then, thermal energy is transferred (directly or indirectly) through the heating wires 6 (14) to the explosive body 3, which is ignited at the touching or contact points. After emerging from the activation unit, the explosive body 3 can burn through completely, and can develop its radiation (e.g., IR radiation).

As already mentioned, as an alternative to making direct contact, contactless activation is also possible, in which case it is necessary to ensure that the individual flares 9 of the explosive body 3 are ignited.

The invention claimed is:

1. An activation unit for munition-free explosive masses or explosive bodies, wherein the activation unit comprises:

(a) an ejection tube;

(b) an ignition tube disposed within the ejection tube, wherein the ignition tube comprises a plurality of high-power heating elements that are fitted in the ejection tube, and each heating element comprises at least one heating wire, wherein the plurality of high-power heating elements are arranged geometrically separately from one another and radially around a circumference of the ignition tube; and (c) a regulation unit connected to supply each heating wire with electric current.

2. The activation unit as claimed in claim 1, each heating wire is held in a casing.

3. The activation unit as claimed in claim 2, wherein the casing comprises a highly temperature-resistant CrNi steel.

4. The activation unit as claimed in claim 1, wherein each respective heating wire is embedded at least in a material that minimizes heat loss.

5. The activation unit as claimed in claim 4, wherein the material is a ceramic inlay.

6. The activation unit as claimed in claim 1, wherein the plurality of heating elements is held in ceramics for mechanical strain relief in a metal structure of the ejection tube, wherein the metal structure corresponds to a respective external shape of an explosive body.

7. The activation unit as claimed in claim 2, wherein each respective heating wire is embedded at least in a material that minimizes heat loss.

8. The activation unit as claimed in claim 7, wherein the material is a ceramic inlay.

9. The activation unit as claimed in claim 3, wherein each respective heating wire is embedded at least in a material that minimizes heat loss.

10. The activation unit as claimed in claim 9, wherein the material is a ceramic inlay.

11. An activation unit for munition-free explosive masses or explosive bodies, wherein the activation unit comprises:

(a) an ejection tube;

(b) an ignition tube disposed within the ejection tube, wherein the ignition tube comprises a plurality of high-power heating elements that are fitted in the ejection tube, and each heating element comprises at least one heating wire, wherein the plurality of high-power heating elements are arranged geometrically separately from one another and radially around a circumference of the ignition tube; and (c) a regulation unit connected to supply each heating wire with electric current so that each heating wire heats to >600° C. and so that the plurality of high-power heating elements ignite approximately 80% surface area of a munition-free explosive mass or explosive body ejected through the ignition tube, wherein each heating wire is held in a casing that comprises a highly temperature-resistant CrNi steel, and each heating wire is embedded in a material that minimizes heat loss, wherein the material is a ceramic inlay.

* * * * *